US009202645B2

(12) United States Patent
Berard et al.

(10) Patent No.: US 9,202,645 B2
(45) Date of Patent: Dec. 1, 2015

(54) SWITCHGEAR FOR A VACUUM CIRCUIT BREAKER COMPRISING LOCKING MEANS

(75) Inventors: David Berard, Villeurbanne (FR); Jean-Pierre Dupraz, Bressolles (FR)

(73) Assignee: ALSTOM TECHNOLOGY LTD., Baden (CH)

( * ) Notice: Subject to any disclaimer, the term of this patent is extended or adjusted under 35 U.S.C. 154(b) by 77 days.

(21) Appl. No.: 13/979,455

(22) PCT Filed: Feb. 2, 2012

(86) PCT No.: PCT/EP2012/051760
§ 371 (c)(1),
(2), (4) Date: Jul. 26, 2013

(87) PCT Pub. No.: WO2012/104377
PCT Pub. Date: Aug. 9, 2012

(65) Prior Publication Data

US 2013/0299321 A1 Nov. 14, 2013

(30) Foreign Application Priority Data

Feb. 2, 2011 (FR) ..... 11 50819

(51) Int. Cl.
*H01H 9/20* (2006.01)
*H01H 33/666* (2006.01)
*H01H 79/00* (2006.01)

(52) U.S. Cl.
CPC ..... *H01H 9/20* (2013.01); *H01H 33/666* (2013.01); *H01H 79/00* (2013.01)

(58) Field of Classification Search
CPC H01H 31/003; H01H 33/126; H01H 33/6661
USPC ..... 218/154
See application file for complete search history.

(56) References Cited

U.S. PATENT DOCUMENTS

| | | | | |
|---|---|---|---|---|
| 2,899,837 | A | 8/1959 | Skarren | |
| 3,445,613 | A | 5/1969 | Louzil et al. | |
| 3,908,473 | A | 9/1975 | Bussen et al. | |
| 3,909,573 | A * | 9/1975 | Wilson | 200/258 |
| 4,538,039 | A * | 8/1985 | Gotoh et al. | 218/3 |

(Continued)

FOREIGN PATENT DOCUMENTS

| | | |
|---|---|---|
| DE | 2708082 A1 | 8/1978 |
| EP | 1583119 A2 | 10/2005 |

(Continued)

OTHER PUBLICATIONS

International Search Report for PCT/EP2012/051760 dated May 16, 2012.

(Continued)

*Primary Examiner* — Truc Nguyen
(74) *Attorney, Agent, or Firm* — Pearne & Gordon LLP

(57) ABSTRACT

A movable portion of a vacuum circuit-breaker includes a circular spring sliding on an outer bearing surface in most positions, that is suitable for entering a recess on relaxing in order to define a maximally open position for the vacuum circuit-breaker in which locking is thus provided. The movable portion may be made up of two sections, of which one, made of copper, is a very good electrical conductor, and is directed towards the stationary contact and receives a connection element for connection to an outside electrical circuit; the section may be made of steel in order to promote sliding of the spring without wear.

13 Claims, 5 Drawing Sheets

(56) References Cited

U.S. PATENT DOCUMENTS

| | | | | |
|---|---|---|---|---|
| 5,422,450 | A * | 6/1995 | Miyazawa et al. | 218/140 |
| 2004/0238494 | A1 * | 12/2004 | Einschenk et al. | 218/154 |
| 2006/0086694 | A1 * | 4/2006 | Benke et al. | 218/154 |
| 2009/0141416 | A1 | 6/2009 | Dommaschk et al. | |
| 2010/0078302 | A1 * | 4/2010 | Erk et al. | 200/400 |

FOREIGN PATENT DOCUMENTS

| | | | |
|---|---|---|---|
| EP | 2141720 | A1 | 1/2010 |
| EP | 2261942 | A2 | 12/2010 |
| FR | 2461347 | A1 | 1/1981 |
| GB | 1585437 | | 4/1978 |
| WO | 2007/075873 | A1 | 8/2007 |
| WO | 2007/095873 | A1 | 8/2007 |

OTHER PUBLICATIONS

International Search Report, PCT/EP2012/051765, Apr. 5, 2012.

* cited by examiner

SWITCHGEAR FOR A VACUUM CIRCUIT BREAKER COMPRISING LOCKING MEANS

The invention relates to switchgear for a vacuum circuit-breaker including particular locking means.

As shown in FIG. 1, a vacuum circuit-breaker comprises, in a casing (1), a stationary portion (2) and a movable portion (3) that have a state of mutual electrical connection in which they are in contact and a state of disconnection in which they are separate. The stationary portion (2) is joined to a conductor (4) passing through the casing (1), and the movable portion (3), which itself passes through the casing (1), is connected to another conductor (5) by a device such as a flexible braid (6). The conductors (4 and 5) are connected to an arbitrary circuit that is not shown. A movement device (7), that is capable of being of a wide variety of shapes, moves the movable portion (3). A stationary abutment (8) defines the open state by stopping movement of the movable portion (3).

Devices of that kind are subjected to various problems that are listed below. For safety reasons, it may be useful to maintain the switchgear in one of its states, e.g. in the open position for a vacuum circuit-breaker, and locking means are thus used in addition to or as a replacement for the abutment (8). Such means may comprise a blade (9) engaging in a recess (10) of the movable portion (3) when the corresponding position is reached. A drawback is thus that an independent mechanism should in principal be used for initiating or interrupting locking, and that makes the device more expensive. An example is given in document US-A-2009/0 141 416 in which the lock-actuating device is a pyrotechnic device which also makes it unsuitable for repeated use.

Reliable locking means are however, even more necessary in a vacuum circuit-breaker, since the vacuum inside the casing (1) attracts the movable portion (3) towards its closed position and can therefore force the closed state in the event of locking failure.

Another difficulty comes from the energy of impacts at the end of movements, when an abutment is reached: that can present dangers for the switchgear as a whole, since the parts are often small and delicate.

Good control of the forces produced when changing state is also desirable in order to guarantee better holding in the desired position.

In the particular field of vacuum circuit-breakers, the invention seeks to provide a new kind of lock that is reliable while being purely passive. In general, the invention relates to switchgear for a vacuum circuit-breaker, the vacuum circuit-breaker including a movable portion, the switchgear including means for moving the movable portion and means for locking the movable portion, which means are capable of penetrating into a recess of the movable portion, the vacuum circuit-breaker being characterized in that the locking means are made up of a helical spring that is wound with tension around the movable portion and that rubs against an outer bearing surface of the movable portion.

An outer bearing surface therefore needs to be provided on the movable portion of the vacuum circuit-breaker in order to receive the spring, which spring rubs on said movable portion during the numerous strokes due to the switching operations of the vacuum circuit-breaker. In spite of the wear that might be feared, it has been found that the locking means are reliable, with any risk of the spring breaking being small.

However, certain precautions may advantageously be taken. In this way, if the recess includes a conical face connected by rounded portions to a recess bottom and to the outer bearing surface of the movable portion, a more moderate transition of the extension of the spring is obtained during switching, and that improves its mechanical behavior and increases its lifespan.

According to another improvement having the same aim, it is advantageous for the movable portion to be composed of two sections made of different materials, the first of which sections comprising the outer bearing surface on which locking takes place and the second of said sections comprising a movable electrical contact inside the vacuum circuit-breaker, the material of the first section being chosen as a function of its mechanical properties, including a high degree of hardness, so as to limit wear of the spring by facilitating sliding thereof, the material of the second section being chosen as a function of its electrical properties, including low resistivity.

Contrary to usual designs, the movable portion is therefore not formed as a single unit, but is composed of two sections assembled by a conventional method or means that may be welding, brazing, adhesive bonding, hot shrink-fitting, or screw-fastening.

In particular embodiments, the switchgear may include an element providing an electrical connection between firstly an electric circuit and secondly the second section of the movable portion of the vacuum circuit-breaker situated between the recess and the movable contact; the materials of the first section and of the second section are copper alloys formed from nano-particles with the aim of obtaining a high degree of mechanical hardness and good electrical conductivity; the outer bearing surface includes a conical portion tapering towards the recess and against which the spring rubs when in a position in which the movable portion touches a stationary contact in the vacuum circuit-breaker, the parts occupying relative positions such as the spring exert axial thrust on the movable portion, said thrust being directed in such a manner as to exert a static pressure on the contacts of the vacuum circuit-breaker in the closed position; the locking and current transfer system is implemented by one or more similar helical springs; the current transfer system is implemented by one or more similar helical springs.

By way of example, the two sections may thus be made of steel and copper respectively.

The invention is described below in connection with the following figures, in which:

FIG. 1, described above, shows a vacuum circuit-breaker;

FIGS. 2*a* and 2*b* show a first embodiment of the invention with the vacuum circuit-breaker in its open and closed states;

Figure 5A:
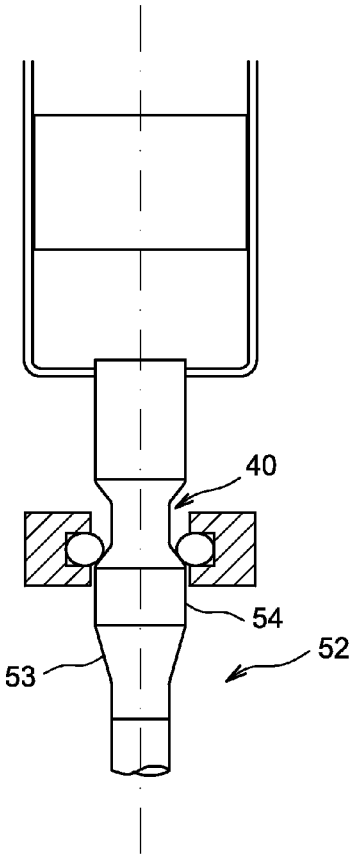
Figure 5B:
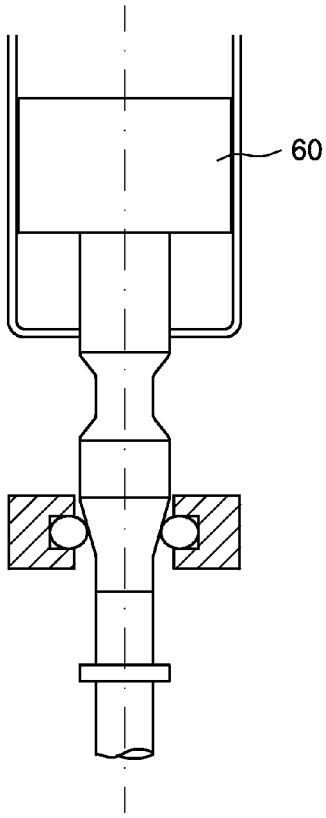
Figure 6:
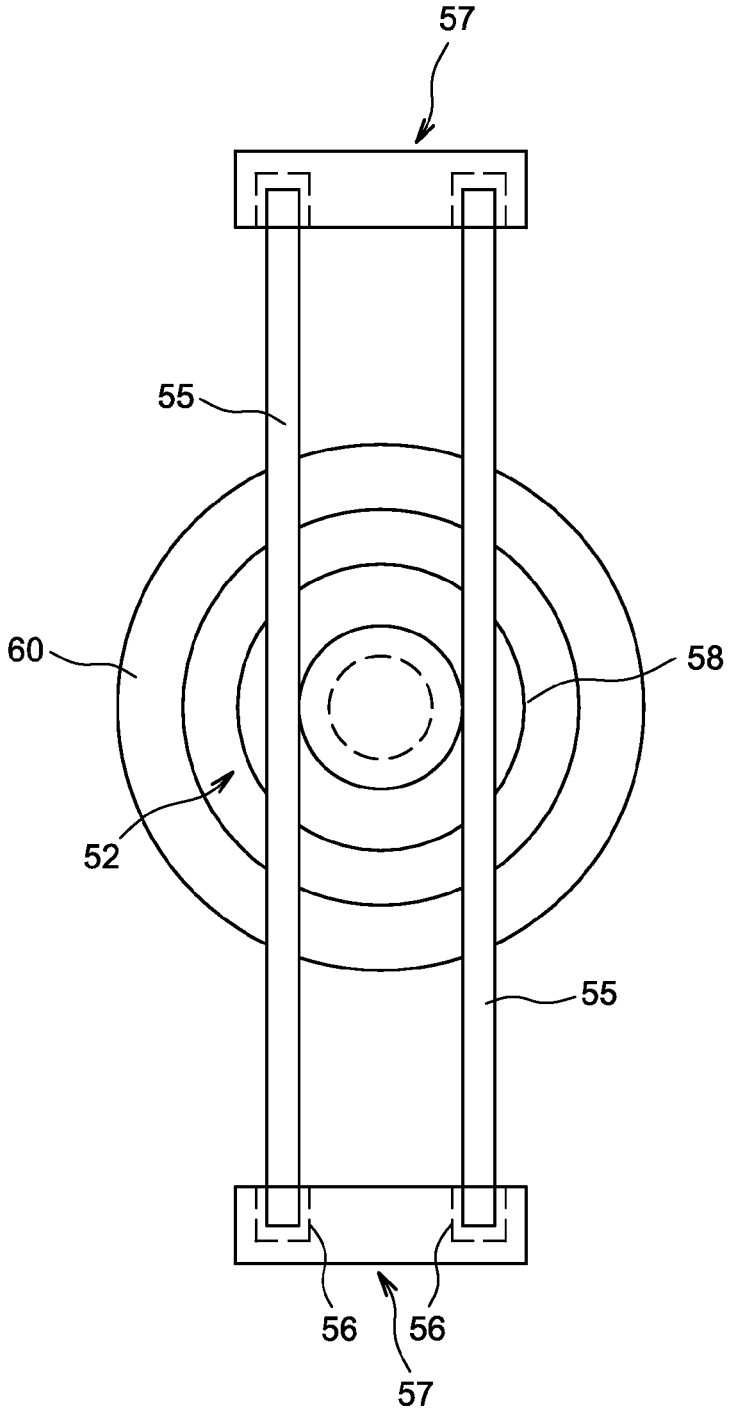

FIGS. 5*a* and 5*b* show a last embodiment of the invention in its open and closed states; and FIG. 6 shows the resilient retaining mechanism.

Figure 1:
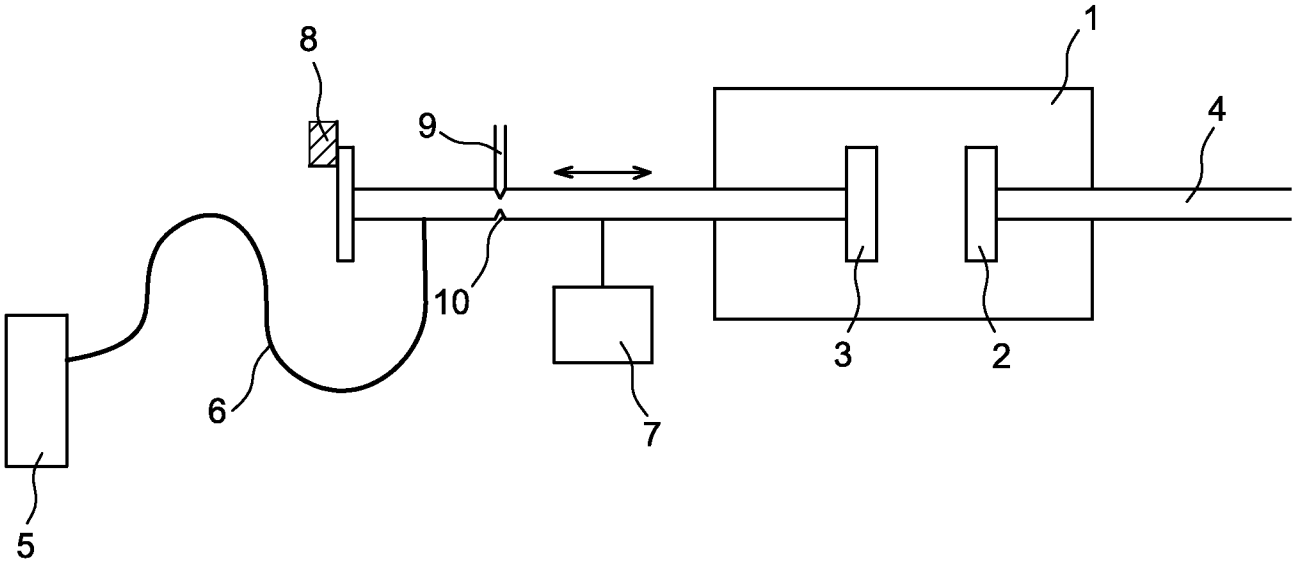
Figure 2B:
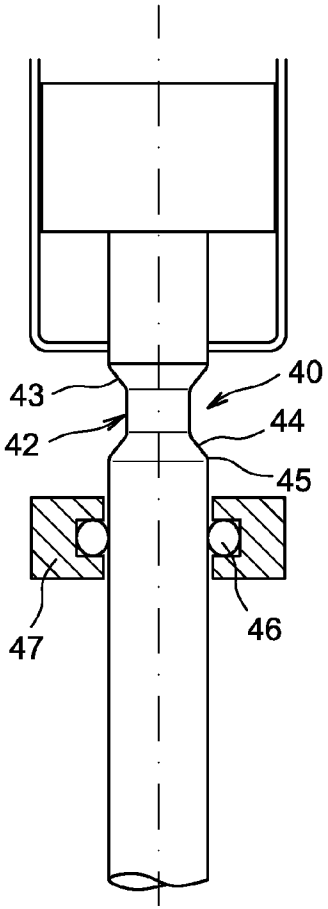
Figure 2A:
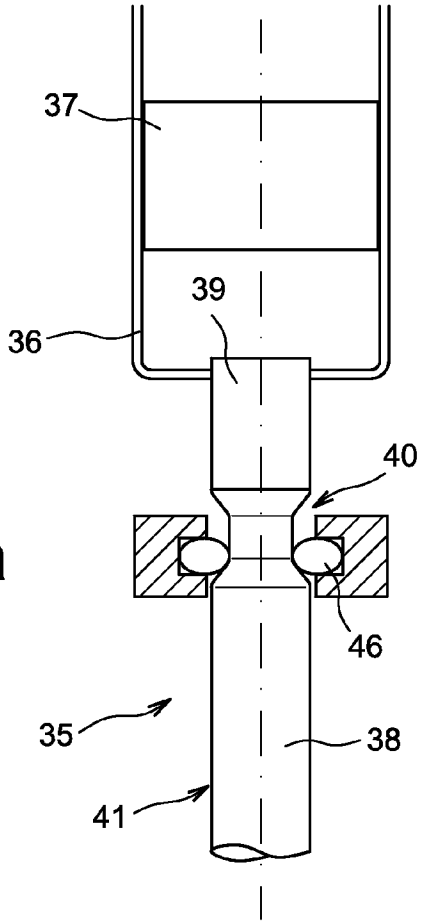

FIGS. 2*a* and 2*b* show the essential elements of the vacuum circuit-breaker, with a first embodiment of the movable portion (35) of the invention, sliding through a casing (36) of the vacuum circuit-breaker, in which there also extends a stationary contact (37). The movable portion (35) comprises a rear first section (38), made of a material that is hard, and a front second section (39), made of a material that is a good electrical conductor, said second section (39) extending inside the casing (36) facing the stationary contact (37), the second section (39) thus constituting a movable electrical contact. FIG. 2*a* shows the vacuum circuit-breaker in the open state, the movable rod (35) being separate from the stationary contact (37), and the FIG. 2*b* shows the vacuum circuit-breaker in the closed state, the movable rod (35) being in contact with the stationary contact.

The first section (38) includes a recess (40) directed towards the second section (39), and an outer bearing surface (41) situated behind the recess (40). The recess (40) includes a recess bottom (42) and a conical face (43) connecting the recess bottom (42) to the outer bearing surface (41); rounded portions (44 and 45) constitute moderate transitions between the conical face (43) and, respectively, the recess bottom (42) and the outer bearing surface (41), in such a manner as to eliminate the sharp edges.

Figure 3:
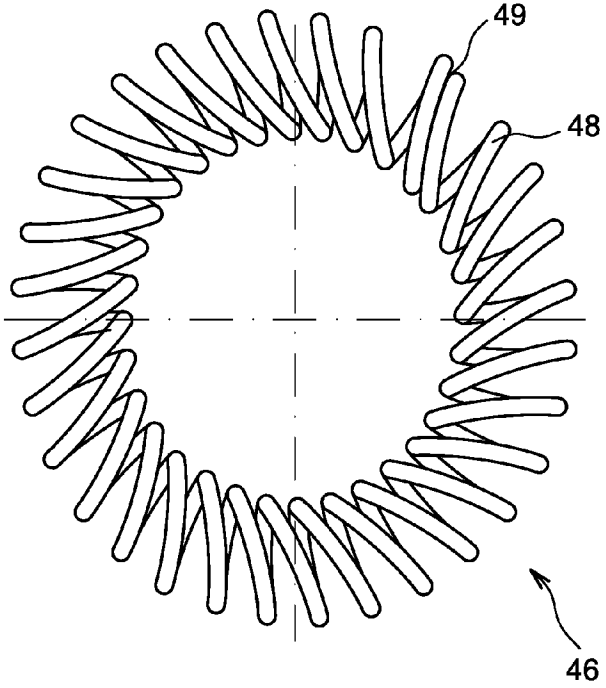
FIG. 3 shows the locking spring.

The switchgear also comprises a helical spring (46) engaging in a recess of a stationary support (47). The movable portion (35) extends through the support (47) at the location of the first section (38). The spring (46) is shown in FIG. 3 and comprises a large number of loops (48) each extending between an outer radius and an inner radius via which the loops come into contact with the movable portion (35). The spring may be manufactured from a conventional helical spring wound into loops and having ends that are welded at a joining point (49). The spring (46) rubs on the outer bearing surface (41) that pushes it (away) radially outwards in most positions of the movable portion (35), except in the widest open state of the vacuum circuit-breaker in which the spring (46) has reached the recess (40) and occupies it by deforming in resilient manner. The locking position thus obtained is stable, the resistance of the spring (46) on being deformed, which promotes its hold in the recess (40), being greater than all of the forces, including the aerostatic force being exerted on the movable portion (35): thrust that promotes returning towards a closed position. This return to the closed position is possible only by deliberately applying an additional force to the movable portion (35).

Figure 4:
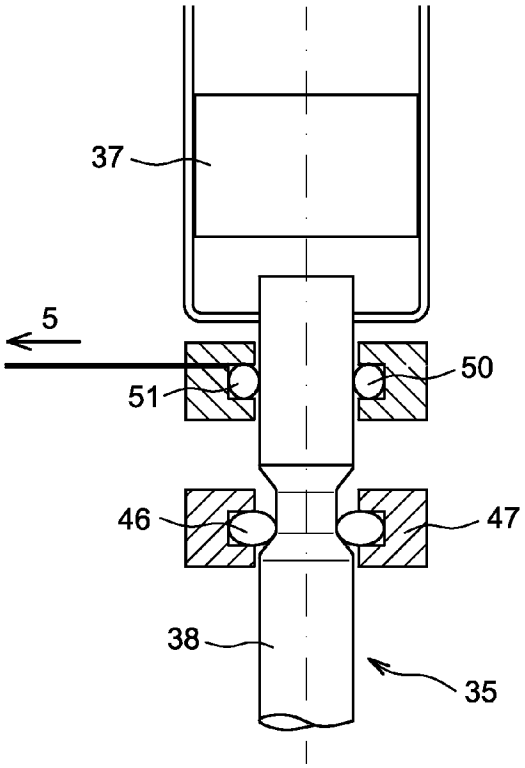
FIG. 4 shows an electrical connection device.

The first section and the second section (38 and 39) may be in contact by any suitable means such as welding, brazing, adhesive bonding, hot shrink-fitting, or screw-fastening. The second section (39) receives an electrical connection element at the fraction of the circuit that is connected to the movable portion (35). In a first embodiment said electrical connection element may be a metal braid or a flexible foil made of a conductive material, connected by welding or brazing at the movable portion (35). In a second embodiment, shown in FIG. 4, contact may be provided by another helical spring (50) that is analogous to the spring (46) and that is, like the spring, engaged in a recess of another stationary support (51).

In an embodiment, the first section (38) and the spring (46) are made of steel, and that enables them to rub against each other with very little wear, thus reducing the risk of the spring breaking, even after a large number of operations.

The first section (39) and the second spring (50) are both made of material that is a very good conductor in order to provide the electrical contact with resistance that is low. The second spring (50) rubbing on a cylindrical shaft is subjected to resilient deformations of smaller amplitude than the first spring (46). Said spring may be selected with dimensions that are different from the first. Its risks of breaking are reduced even if it is not made of steel.

In various advantageous but optional arrangements, the movable portion (35) includes at least an axisymmetrical zone, or is even completely axisymmetrical, so that its orientation relative to the system for fastening the two sections of the movable portion makes no difference. The force exerted on the movable portion (35) by the wound helical springs (46) is determined at will by appropriately selecting the inside and outside diameters of wound helical springs, the diameters and the kinds of wires used, and also the diameters of the profile of the movable portion (35), of the positioning of the recess receiving the wound helical springs (46), and of the depth of said recess. The wound helical springs should remain within their elastic range. The materials used for the helical springs (46), for the section of the movable portion (39) and for the support (47) need to be appropriately selected so as to have good electrical conductivity. The state of the surface of said elements needs to be appropriate. In a preferred embodiment, silver plating of the surface is carried out.

In another embodiment, a single spring provides both the mechanical locking function in the open position, and the electrical function of passing current. In a variant embodiment, a plurality of springs are implemented, each providing said double function of locking in the open position and of passing electricity.

Another embodiment is described by means of FIGS. 5*a* and 5*b*, which also show open and closed states of the switchgear. In this embodiment, the movable portion (52) differs from the above-described portion in that it includes a conical fraction (53) forming part of the outer bearing surface (54), behind the recess (40). By means of this arrangement, the spring (46) extends over the conical portion (53) when the vacuum circuit-breaker is in the closed state, shown in FIG. 5*b*, and may thus exert an axial force component. This axial force component that promotes closing therefore makes it possible to compensate for potential faults in the mechanism due to wear or to any other reason that could reduce the quality of the electrical contact between the movable portion (52) and the stationary portion (60).

This invention may be combined with another invention for which a patent application is being filed simultaneously to the present application, and in which the movable portion cooperates with spring wires that are suitable for reversibly locking by entering into a recess or reaching an abutment on the movable portion, and with good damping as a result of their resiliency.

What is claimed is:

1. Switchgear for a vacuum circuit-breaker, the vacuum circuit-breaker including a movable portion, the switchgear including means for moving the movable portion and means for locking the movable portion, the means for locking being capable of penetrating into a recess of the movable portion, wherein the means for locking comprise a helical spring that is wound into a loop with ends that are joined together, the spring being wound with tension around the movable portion and rubbing against an outer bearing surface of the movable portion.

2. The switchgear according to claim 1, wherein the recess includes a conical face connected by rounded portions to a recess bottom and to the outer bearing surface of the movable portion.

3. The switchgear according to claim 1, wherein the movable portion comprises two sections made of different materials, a first section comprising the recess and the outer bearing surface and a second section comprising a movable electrical contact inside a vacuum circuit-breaker.

4. The switchgear according to claim 3, wherein the material of the first section is steel based and the material of the second section is copper based.

5. The switchgear according to claim 3, wherein the materials of the first section and of the second section are copper alloys formed from nano-particles with the aim of obtaining a high degree of mechanical hardness and good electrical conductivity.

6. The switchgear according to claim 3, further comprising an element providing an electrical connection between firstly an electric circuit and secondly the second section of the movable portion of the vacuum circuit-breaker situated between the recess and the movable contact.

7. The switchgear according to claim 1, wherein the outer bearing surface includes a conical portion tapering towards the recess and against which the spring rubs when in a position in which the movable portion touches a stationary contact in the vacuum circuit-breaker, the movable portion and the spring occupying relative positions, wherein the spring exerts an axial thrust on the movable portion, said thrust being directed in such a manner as to exert a static pressure on the contacts of the vacuum circuit-breaker in the closed position.

8. The switchgear according to claim 1, wherein the means for locking and a current transfer system are implemented by helical springs wound into a loop.

9. The switchgear according to claim 3, wherein a current transfer system is implemented by one or more similar helical springs.

10. The switchgear according to claim 9, wherein the current transfer system is a flexible conductive braid or a flexible conductive foil.

11. The switchgear according to claim 9, wherein the current transfer system is a second helical spring that is wound around the second section and that rubs on the second section.

12. The switchgear according to claim 3, wherein the first section is made of a first material chosen as a function of mechanical properties of the first material, and the second section is made of a second material chosen as a function of electrical properties of the second material.

13. The switchgear according to claim 12, wherein the first material has a high degree of hardness and low coefficient of friction, and the second material has good conductivity.

* * * * *